US009133687B2

(12) United States Patent
Sloan et al.

(10) Patent No.: US 9,133,687 B2
(45) Date of Patent: Sep. 15, 2015

(54) TUBING PRESSURE INSENSITIVE PRESSURE COMPENSATED ACTUATOR FOR A DOWNHOLE TOOL AND METHOD

(75) Inventors: James T. Sloan, Tulsa, OK (US); Ronald J. Garr, Inola, OK (US); Robert McDaniel, Spring, TX (US); Don A. Hopmann, Alvin, TX (US); David E. Schneider, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 863 days.

(21) Appl. No.: 13/210,999

(22) Filed: Aug. 16, 2011

(65) Prior Publication Data

US 2013/0043039 A1 Feb. 21, 2013

(51) Int. Cl.

| | |
|---|---|
| ***E21B 34/10*** | (2006.01) |
| ***E21B 34/14*** | (2006.01) |
| *E21B 34/00* | (2006.01) |

(52) U.S. Cl.

CPC ..... *E21B 34/10* (2013.01); *E21B 34/101* (2013.01); *E21B 34/14* (2013.01); *E21B 2034/005* (2013.01)

(58) Field of Classification Search

USPC ..... 166/324

See application file for complete search history.

(56) References Cited

U.S. PATENT DOCUMENTS

| | | | | |
|---|---|---|---|---|
| 4,062,406 | A | 12/1977 | Akkerman et al. | |
| 4,444,266 | A | 4/1984 | Pringle | |
| 5,058,682 | A | 10/1991 | Pringle | |
| 6,041,857 | A | 3/2000 | Carmody et al. | |
| 6,173,785 | B1 | 1/2001 | Adams et al. | |
| 6,513,594 | B1 * | 2/2003 | McCalvin et al. | 166/320 |
| 7,743,833 | B2 | 6/2010 | Cascario et al. | |
| 7,967,074 | B2 * | 6/2011 | Lake et al. | 166/386 |
| 8,453,748 | B2 * | 6/2013 | Vick et al. | 166/373 |
| 8,464,799 | B2 * | 6/2013 | Scott et al. | 166/373 |
| 2006/0196669 | A1 | 9/2006 | Lauderdale et al. | |

OTHER PUBLICATIONS

Hill, A New Completion System for Surface-Controlled Subsurface Safety Valves, Journal Paper, vol. 26, No. 3, Mar. 1974, Journal of Petroleum Engineers.

Calhoun, Subsurface Safety Systems for TLP Completions, Conference Paper, SPE 12996, Oct. 25-28, 1984, Society of Petroleum Engineers.

(Continued)

*Primary Examiner* — Jennifer H Gay
*Assistant Examiner* — Caroline Butcher
(74) *Attorney, Agent, or Firm* — Cantor Colburn LLP

(57) ABSTRACT

A tubing pressure insensitive, pressure compensated actuator system includes a housing having a bore therein. A force transmitter sealingly moveable within the bore. The force transmitter defining with the bore two fluid chambers. The two fluid chambers being in fluid communication with each other, one at each longitudinal end of the force transmitter. An activator in one or both of the two fluid chambers and operatively connected to the force transmitter. At least two seals sealingly positioned between the housing and the force transmitter. One of the seals disposed near one end of the force transmitter and another of the seals disposed near another end of the force transmitter. A separate compensation piston disposed in the housing so as to expose one end of the compensation piston to tubing pressure and to expose the other end of the compensation piston to a fluid volume including the fluid chambers. Also included is a method for reducing force requirements of an actuator.

16 Claims, 4 Drawing Sheets

(56) References Cited

OTHER PUBLICATIONS

Bussear, Design and Qualification of a Remotely-Operated, Downhole Flow Control System for High-Rate Water Injection in Deepwater, Conference Paper, SPE 88563, Oct. 18-20, 2004, Society of Petroleum Engineers.

International Search Report and Written Opinion, Date of Mailing Feb. 13, 2013, International Application No. PCT/US2012/049439, Korean Intellectual Property Office, International Search Report 5 pages, Written Opinion 2 pages.

* cited by examiner

TUBING PRESSURE INSENSITIVE PRESSURE COMPENSATED ACTUATOR FOR A DOWNHOLE TOOL AND METHOD

BACKGROUND

Actuation of downhole tools in the drilling and completion industry is ubiquitous. Many operations in the downhole environment require the use of tools that are run in the hole in a first position to be actuated later to a second position. There are many ways to actuate such tools using hydraulic pressure, mechanical actuation, electric actuation, etc. Many of the current tools in order to actuate, must be configured to overcome tubing pressure. This is because tubing pressure acts against a feature such as a piston against which an actuator does work to actuate the tool. In such situation, an activator in such actuator system must not only generate energy to move the tool but must overcome the tubing pressure acting against the activator at the same time. Attempts have been made to isolate tubing pressure but suffer from dynamic friction at the seals that hampers the operation as well as causing systems to have increased cost to net acceptable longevity. The art would therefore well receive alternative arrangements that reduce activation energy required so that reliability and cost factors can be improved.

SUMMARY

A tubing pressure insensitive, pressure compensated actuator system includes a housing having a bore therein; a force transmitter sealingly moveable within the bore the force transmitter defining with the bore two fluid chambers, the two fluid chambers being in fluid communication with each other, one at each longitudinal end of the force transmitter; an activator in one or both of the two fluid chambers and operatively connected to the force transmitter; at least two seals sealingly positioned between the housing and the force transmitter, one of the seals disposed near one end of the force transmitter and another of the seals disposed near another end of the force transmitter; and a separate compensation piston disposed in the housing so as to expose one end of the compensation piston to tubing pressure and to expose the other end of the compensation piston to a fluid volume including the fluid chambers.

A tubing pressure insensitive pressure compensated actuator system for an electric surface controlled subsurface safety valve includes a subsurface safety valve housing supporting a flow tube, a flapper and a power spring, the housing having a force transmitter bore therein; a force transmitter sealingly moveable within the bore the force transmitter defining with the bore two fluid chambers, the two fluid chambers being in fluid communication with each other, one at each longitudinal end of the force transmitter; an activator in one or both of the two fluid chambers and operatively connected to the force transmitter; at least two seals sealingly positioned between the housing and the force transmitter, one of the seals disposed near one end of the force transmitter and another of the seals disposed near another end of the force transmitter; and a separate compensation piston disposed in the housing so as to expose one end of the compensation piston to tubing pressure and to expose the other end of the compensation piston to a fluid volume including the fluid chambers.

A method for reducing force requirements of an actuator in a downhole environment including sealing a force transmitter within a housing to isolate ends of the force transmitter from tubing pressure during use, respective ends being in communication with fluid chambers fluidly connected with each other; applying tubing pressure to a fluid in the fluid chambers; and initiating an activator to urge the force transmitter in a direction commensurate with activating a downhole tool, the activator generating enough force to activate the downhole tool other than to overcome tubing pressure.

BRIEF DESCRIPTION OF THE DRAWINGS

Referring now to the drawings wherein like elements are numbered alike in the several Figures.

DETAILED DESCRIPTION

Figure 1:
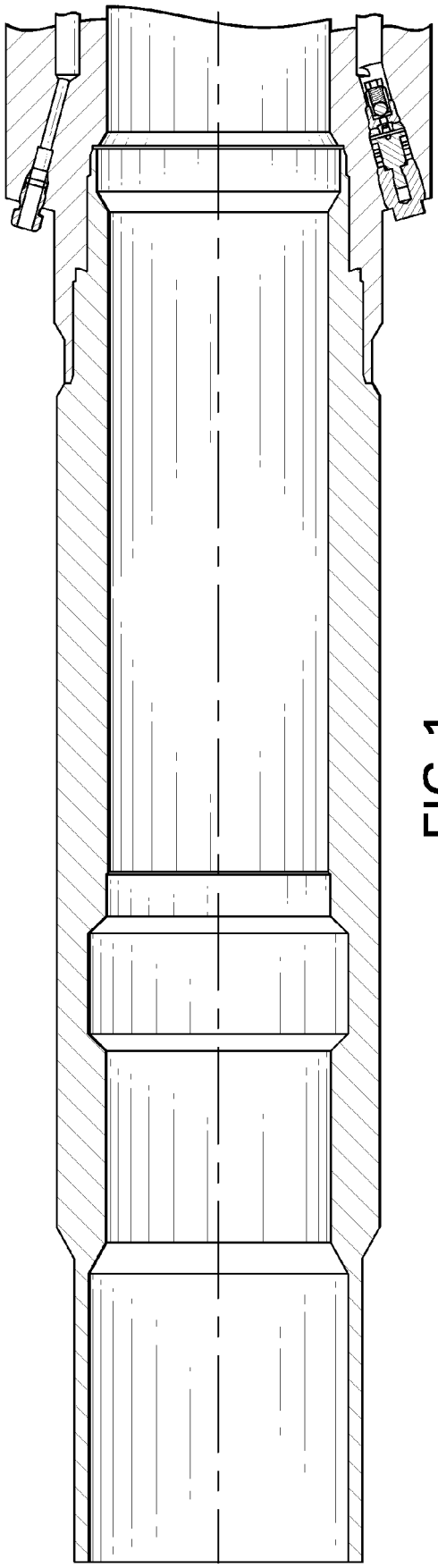
FIGS. 1-4 are an elongated cross sectional view of a portion of a tubing pressure insensitive pressure compensated actuation system.
Figure 2:
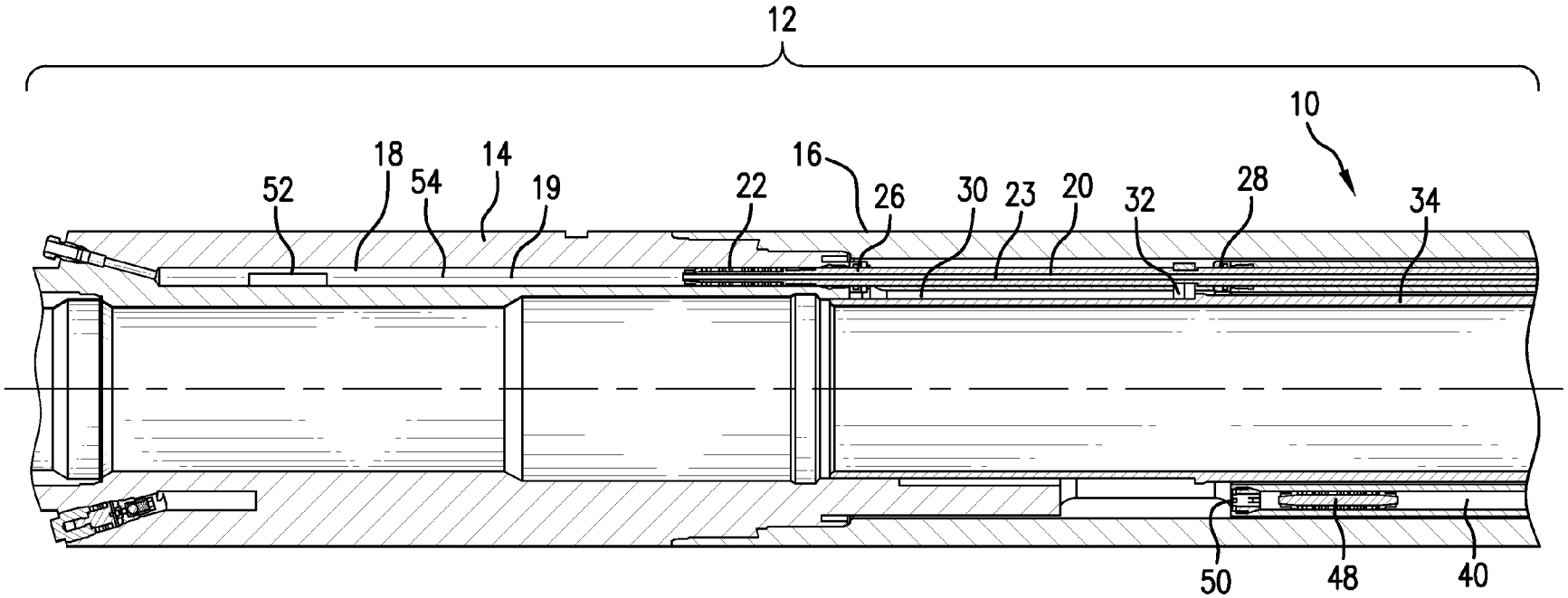

Referring to FIGS. 1-4 simultaneously, an embodiment of a tubing pressure insensitive pressure compensated actuation system 10 is illustrated. The system includes a housing 12 configured in this embodiment with an extended cylinder sub 14 and a piston housing 16. The housing 12 includes a bore 18 therein receptive of a force transmitter 20 illustrated as a rod piston. The force transmitter as positioned within the bore 18 effectively creates two fluid chambers 19 and 21, one on either end of the force transmitter. The chambers are volume changeable of course due to translational movement of the force transmitter in the bore 18. The force transmitter includes a channel 23 extending therethrough to fluidly couple chamber 19 to chamber 21. This prevents fluid pressure changes on either end of the translating force transmitter solely from the translatory motion. The force transmitter 20 supports a seal 22 at one end thereof and a seal 24 at an opposite end thereof. The force transmitter 20 may either carry the seal, which is then slidable in the bore or the bore may carry the seal and the seal would then slide on the force transmitter 20. The bore 18 is longer than the force transmitter 20 to allow for translation of the force transmitter 20 within the bore 18. Bearings 26 and 28 are also provided to support the translatory motion of the force transmitter in use. While the bearings 26 and 28 do not necessarily have to be in the positions in which they are depicted in FIG. 2, they conveniently help identify an opening 30 through which an interengagement 32 from the force transmitter 20 extends into contact with a flow tube 34. This opening 30 also provides the tubing pressure insensitivity ability as tubing pressure is equally and oppositely applied to seals 22 and 24[JTS1]. The interengagement 32 ensures that the flow tube moves with the force transmitter 20 at least in a first direction. As configured in the illustration, the flow tube will cause the force transmitter to move with it in the opposite direction. In one embodiment, the first direction is a direction that will open a flapper 36 (see FIG. 4) of a safety valve. The opposite direction will be that of movement of the flow tube 34 under the urging of a power spring 38 (see FIG. 3). It is noted that the components illustrated in FIGS. 1-4 that are specifically related to a safety valve, which is one embodiment of a tool that could benefit from the use of the tubing pressure insensitive pressure compensated actuation system, are well known to those of skill in the art and need not be described.

Figure 3:
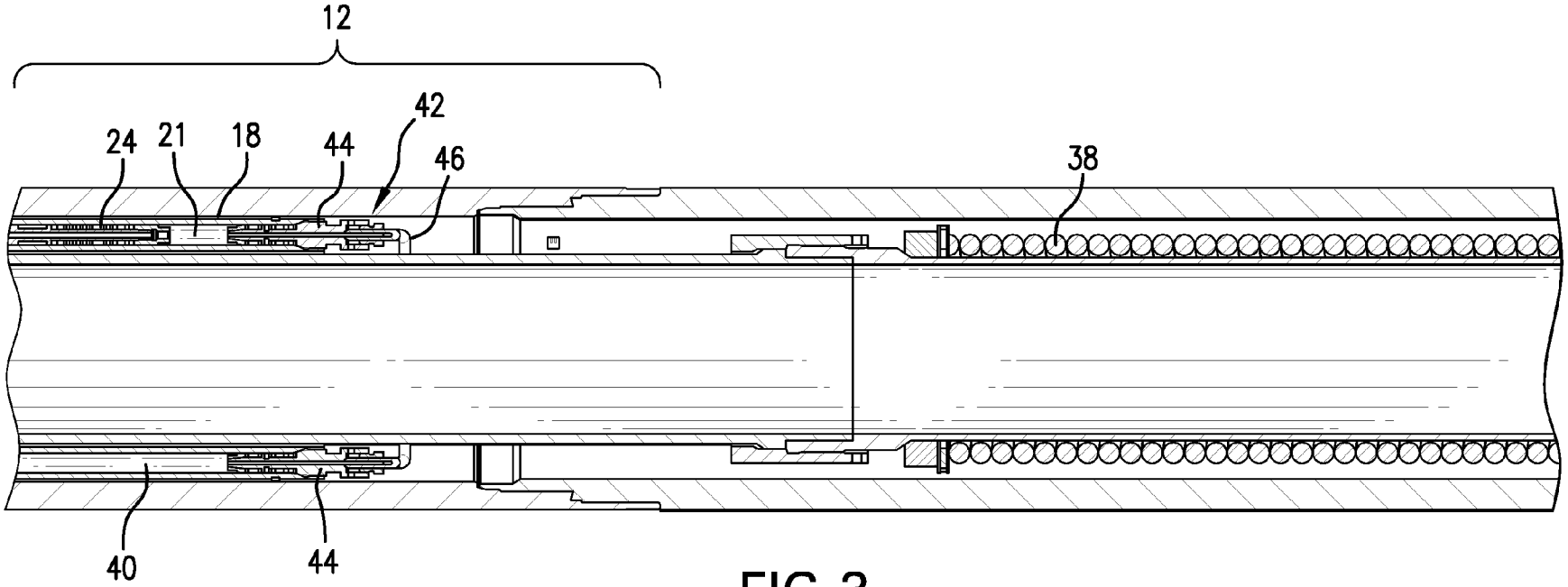
Figure 4:
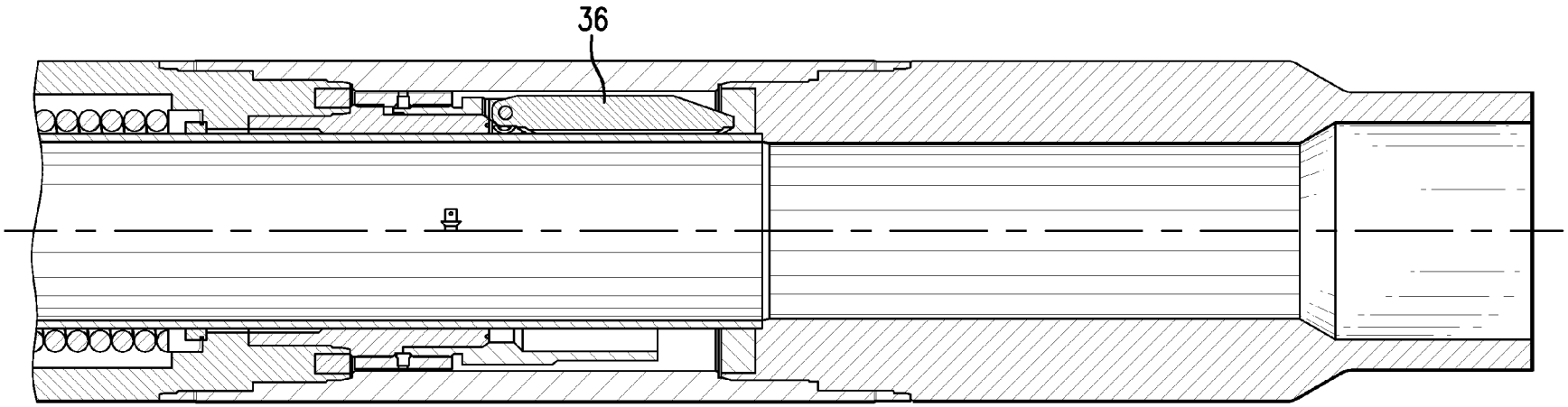

Returning to the actuation system 10, and focusing upon FIG. 3, it is noted that the bore 18 is at one end thereof, fluidly connected to another bore 40 through a fluid communication subsystem 42. The subsystem 42 in one embodiment comprises a connector 44 sealed to the bore 18 and a connector 44 sealed to the bore 40. The connectors 44 are connected to each other with a fluid communication device 46, illustrated in this embodiment as a control line. In this embodiment, the control line can be easily formed to wrap around the flow tube 34 to provide the needed fluid communication between bore 18 and bore 40. The invention should not be construed to be limited to the control line as other fluid conveying means could be substituted providing that they are capable of moving pressurized fluid between bore 18 and bore 40.

Moving to FIG. 2, it will be appreciated that within bore 40 is positioned a compensation piston 48 slidingly sealed to the bore 40. The bore 40 is open to tubing pressure somewhere along bore 40 that allows the positioning of the compensation piston 48 between the opening 50 and the connector 44 where bore 40 connects to subsystem 42. This allows for the translation of compensation piston 48 within the bore 40 to pressure compensate the fluid on a side of the compensation piston opposite the side of the compensation piston that is exposed to tubing pressure.

With the configuration as described and in the embodiment shown, an electric or mechanical activator 52 disposed in one or both of chambers 19 and 21 (19 as illustrated) is connected to the force transmitter 20 by connection 54. This connection may be a lead screw or other mechanical connection (e.g. motor or solenoid). The Activator(s) need generate only enough force to actuate the tool being actuated without having to overcome tubing pressure to do so. More specifically, in the case of the subsurface safety valve as illustrated, the force generated only need be sufficient to compress the power spring 38 and rotate the flapper 36 (likely against the biasing force of a torsion spring not numbered). This is significantly less force than would be needed if tubing pressure also had to be overcome. In addition, since dielectric fluid (e.g. oil or even air in some cases if compressibility is acceptable in a specific application) in bore 18 and bore 40 would be pressure compensated by the action of compensation piston 48, there would be little to no dynamic pressure across seals 22 and 24, thereby reducing friction that would otherwise have to be overcome. Another benefit is that the seals will wear longer since there is no significant differential pressure across them.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A tubing pressure insensitive, pressure compensated actuator system comprising:

a housing having a bore therein;

a force transmitter sealingly moveable within the bore the force transmitter defining with the bore two fluid chambers, the two fluid chambers being fluidically connected with each other, one at each longitudinal end of the force transmitter;

an activator in one or both of the two fluid chambers and operatively connected to the force transmitter;

at least two seals sealingly positioned between the housing and the force transmitter, one of the seals disposed near one end of the force transmitter and another of the seals disposed near another end of the force transmitter; and a separate compensation piston disposed in the housing so as to expose one end of the compensation piston to tubing pressure and to expose the other end of the compensation piston to a fluid volume including the fluid chambers.

2. The system as claimed in claim 1 wherein the housing is a housing of a subsurface safety valve.

3. The system as claimed in claim 1 wherein the activator is mechanical.

4. The system as claimed in claim 1 wherein the activator is at least in part electrical.

5. The system as claimed in claim 4 wherein the activator is in mechanical communication with the force transmitter.

6. The system as claimed in claim 4 wherein the activator is a motor and a lead screw.

7. The system as claimed in claim 4 wherein the activator is a solenoid.

8. The system as claimed in claim 1 wherein the compensation piston translates in parallel to an axis of the housing.

9. The system as claimed in claim 8 wherein the compensation piston is fluidly connected to the fluid chambers via a fluid communication subsystem.

10. The system as claimed in claim 1 wherein the force transmitter includes an interengagement for a flow tube.

11. The system as claimed in claim 1 wherein the force transmitter includes a channel axially extending from one force transmitter end to an opposite force transmitter end through the force transmitter thereby allowing fluid communication from a fluid chamber at one end of the force transmitter to a fluid chamber at the other end of the force transmitter through the force transmitter.

12. The system as claimed in claim 1 wherein the housing further contains a fluid isolated from wellbore fluid.

13. The system as claimed in claim 12 wherein the fluid is dielectric fluid.

14. The system as claimed in claim 13 wherein the dielectric fluid is air.

15. A tubing pressure insensitive pressure compensated actuator system for an electric surface controlled subsurface safety valve comprising:

a subsurface safety valve housing supporting a flow tube, a flapper and a power spring, the housing having a force transmitter bore therein;

a force transmitter sealingly moveable within the bore the force transmitter defining with the bore two fluid chambers, the two fluid chambers fluidically connected with each other, one at each longitudinal end of the force transmitter;

an activator in one or both of the two fluid chambers and operatively connected to the force transmitter;

at least two seals sealingly positioned between the housing and the force transmitter, one of the seals disposed near one end of the force transmitter and another of the seals disposed near another end of the force transmitter; and a separate compensation piston disposed in the housing so as to expose one end of the compensation piston to tubing pressure and to expose the other end of the compensation piston to a fluid volume including the fluid chambers.

16. A method for reducing force requirements of an actuator in a downhole environment comprising:

sealing a force transmitter within a housing to isolate ends of the force transmitter from tubing pressure during use, respective ends being in communication with fluid chambers fluidly connected with each other;

applying tubing pressure to a fluid in the fluid chambers; and initiating an activator to urge the force transmitter in a direction commensurate with activating a downhole tool, the activator generating enough force to activate the downhole tool other than to overcome tubing pressure.

* * * * *